US005437415A

United States Patent [19]

May

[11] Patent Number: 5,437,415

[45] Date of Patent: Aug. 1, 1995

[54] DRUM CONDITIONER

[75] Inventor: Lindy L. May, Strafford, Mo.

[73] Assignee: Custom Metalcraft, Inc., Springfield, Mo.

[21] Appl. No.: 165,902

[22] Filed: Dec. 14, 1993

[51] Int. Cl.[6] ..... B02C 17/18

[52] U.S. Cl. ..... 241/299; 241/102

[58] Field of Search ..... 241/102, 284, 299

[56] References Cited

U.S. PATENT DOCUMENTS 2,664,675 1/1954 La Monica ..... 241/102 X 3,820,726 6/1974 Tokechi et al. ..... 241/102

*Primary Examiner*—Timothy V. Eley

*Attorney, Agent, or Firm*—Nies, Kurz, Bergert & Tamburro

[57] ABSTRACT

A drum conditioner which is capable of providing an external force on a drum so as to crack and loosen powdered or other finely divided material therein which has solidified and hardened is disclosed. The drum conditioner includes two pairs of pressure rollers which provide pressure to the drum and help rotate the drum as it sits on a conveyer bed of rollers. The pair of pressure rollers in the rear are adjustable so as to accommodate different size drums. The front pair of pressure rollers are provided with a hydraulic cylinder to assist in providing and maintaining pressure between the pressure rollers and the object drum, regardless of the regularity of shape of the drum.

11 Claims, 5 Drawing Sheets

DRUM CONDITIONER

BACKGROUND AND SUMMARY OF THE INVENTION

The present invention relates to drums or containers, and more particularly to a drum conditioner which is capable of providing an external force on a container so as to crack and loosen powdered products or other material in a finely divided state which has solidified and hardened within the container.

It is well known in the industrial world that powdered material held in storage containers that have been sitting for long periods of time tends to solidify and harden and thus becomes difficult to remove and manipulate. Past solutions range from striking the outside of the container with a heavy object to shaking or stirring the contents of the container. Such efforts are often time consuming and do not generally prove effective in loosening the entire mass of material.

It is thus one object of the present invention to provide a drum conditioner which quickly and effectively loosens a powdered or other finely divided product contained in the drum.

It is another object of the present invention to provide a drum conditioner which is capable of rotating the container or drum while pressure is applied on the outer surface of the drum so as to loosen the product around the perimeter of the product core, thus facilitating removal of the product from the drum.

It is yet another object of the present invention to provide a drum conditioner in which outside pressure is applied in a stepped profile along the length of the drum through the use of pressure rollers and in which opposing pressure points are staggered relative to each other so as to create cross-cracking in the product core as well as longitudinal cracking.

It is still a further object of the present invention to provide a drum conditioner which can accommodate different diameter drums.

It is also an object of the present invention to provide a drum conditioner which can accommodate drums which are not perfectly circular in cross section while maintaining such a drum in working position.

It is still another object of the present invention to provide a drum conditioner with a roller conveyer bed to facilitate the entry and exit of the drums.

It is yet another object of the present invention to provide a support surface for support of the drum during operation of the drum conditioner which is separate from the roller conveyer bed.

DESCRIPTION OF THE PREFERRED EMBODIMENTS

Figure 1:
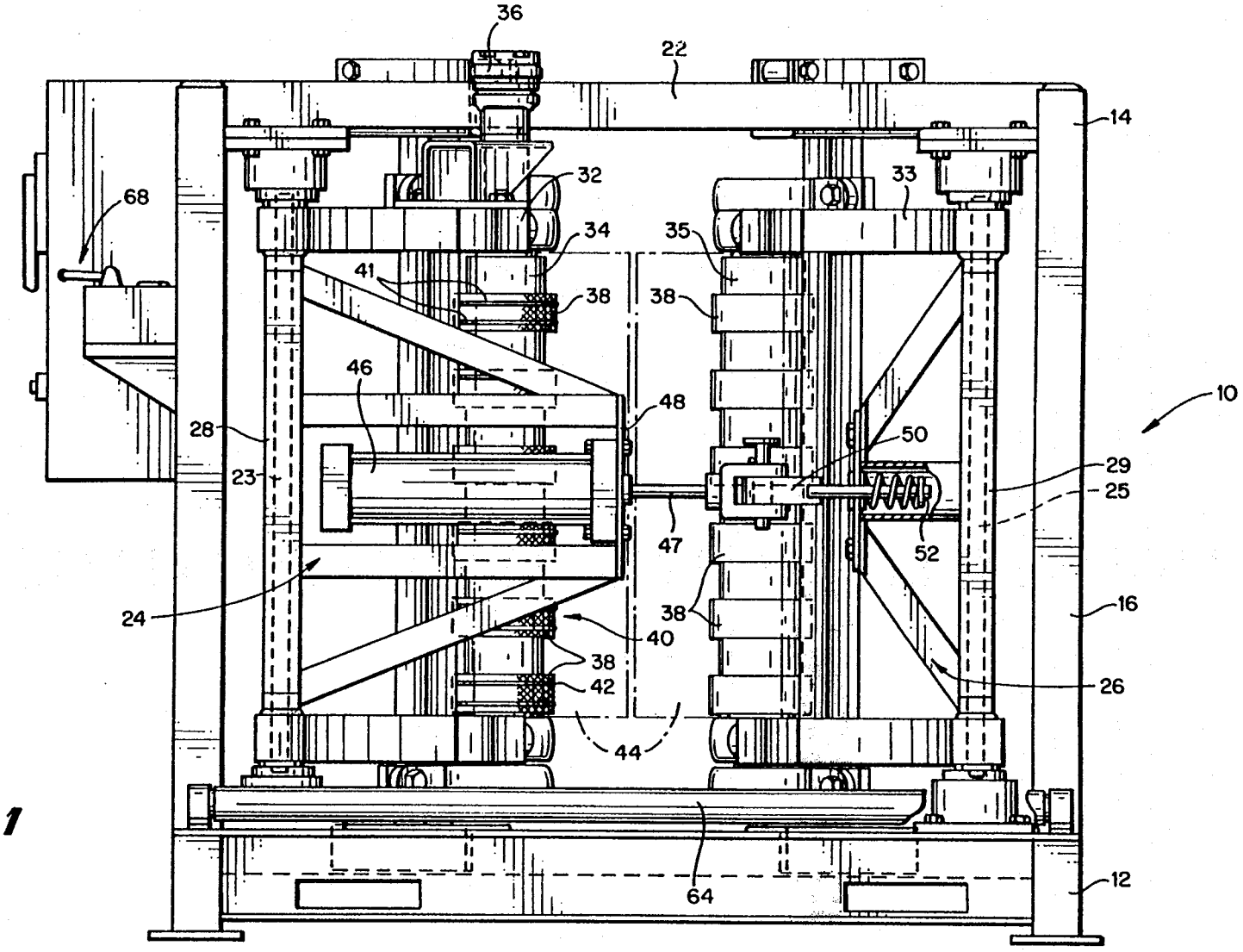
FIG. 1 is a front elevation of the drum conditioner of the present invention with the dashed lines showing the roller guards.

Referring to FIGS. 1 through 5, by the present invention there is provided a drum conditioner 10 having a base 12 and a main frame 14. The main frame 14 has front 16, back 18, and top 20 portions and is provided with a central frame support 22 mounted to the top portion 20. The front portion 16 of the main frame 14 is provided with a left 24 and right 26 gate assembly to facilitate manual entry and exit of the drums. The left 24 and right 26 gate assemblies each have a frame tube portion 28, 29 pivotally mounted on respective pivot rods 23, 25 connected to the central frame support 22 and the base 12. Also, a front pressure roller mounting weldment 32, 33 is mounted to the frame tube portion 28, 29 of both gate assemblies 24, 26.

Each front pressure roller mounting weldment 32, 33 extends towards the center of the drum conditioner 10 and has a front pressure roller 34, 35 rotatably mounted at its inner end. A hydraulic motor 36 is mounted on top of the left front pressure roller mounting weldment 32 with hydraulic pressure from unit 37 for providing power to the left front pressure roller 34 when the drum conditioner 10 is in operation.

Each front pressure roller 34, 35 is provided with a series of pressure roller sleeves 38 which are slidably adjustable along the length of the respective roller 34, 35 to accommodate different drum heights and to avoid the top and bottom rims of the drum. The sleeves 38 on the left front pressure roller 34 are provided with knurled edges 40 and also with grooves 41 for the placement of O-rings 42. The knurled edges 40 and the O-rings 42 assist in providing extra traction on the object drum during rotation. Front pressure roller guards 44 are mounted to the frame tube portion 28, 29 of both gate assemblies 24, 26 for safety reasons.

Figure 3:
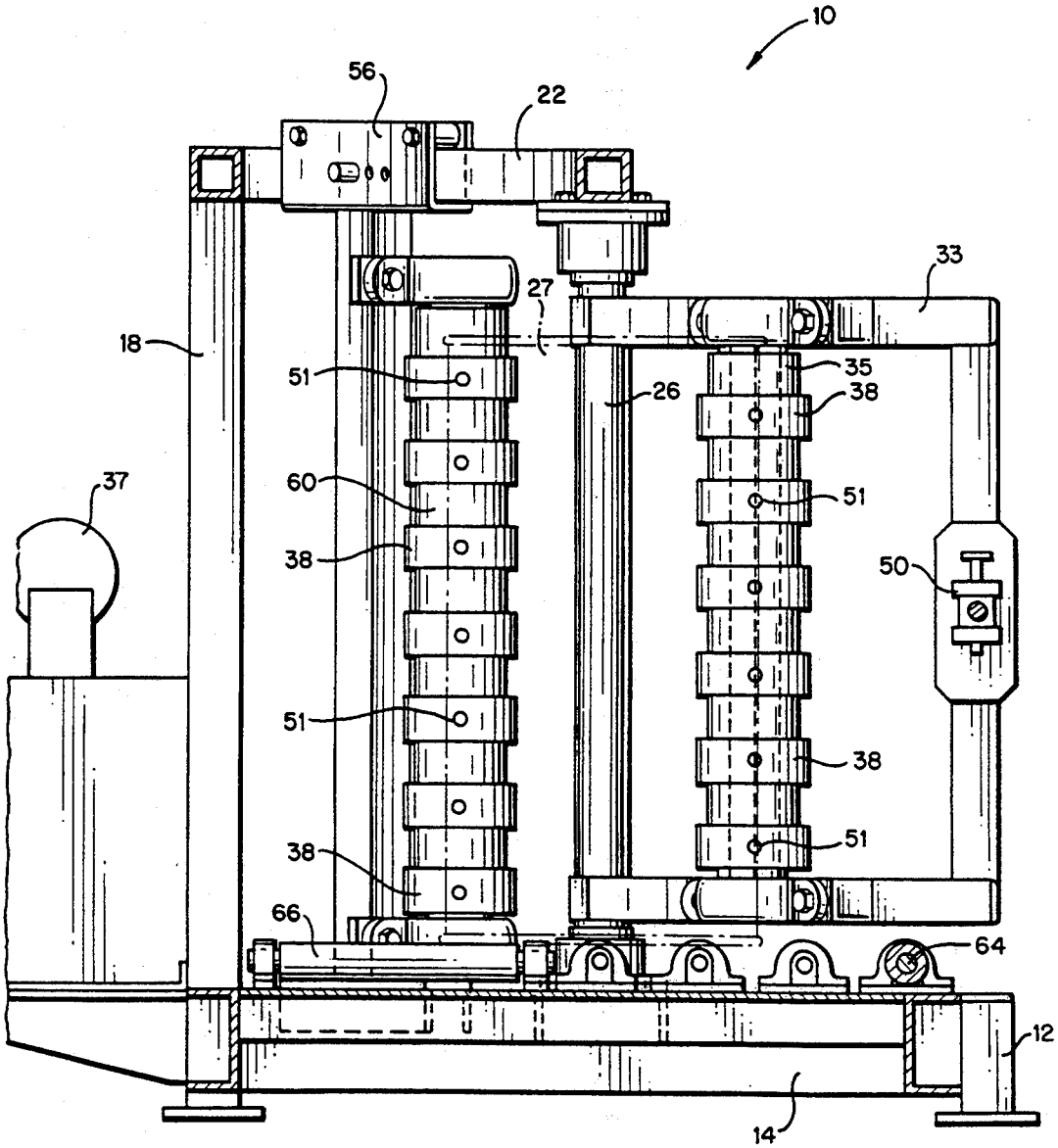
FIG. 3 is a cross-section of the drum conditioner of the present invention taken along line 3—3 of FIG. 2.

The front gate assemblies 24, 26 are equipped with a horizontally extending hydraulic cylinder 46 which is used to apply the pressure on the object drum. The left gate assembly 24 includes a hydraulic cylinder mounting assembly 48 which houses the hydraulic cylinder 46 and piston rod 47. The right gate assembly 26 is provided with a rod-end clevis attachment 50 which engages the piston rod 47 during operation. The clevis attachment 50 also is provided with a compression spring 52 to permit constant contact of the pressure roller sleeves 38 with the object drum during rotation in the event an out-of-round drum is used. The sleeves 38 are adjustable along the height of the front pressure rollers 34, 35 but are fixedly mounted during operation by means such as a cap screw 51 extending through a sleeve 38 to releasably attach the sleeve 38 to the roller, as shown in FIG. 3.

The back portion 18 of the main frame 14 of the drum conditioner 10 is provided with back pressure roller mounting assemblies 54, 56 movably mounted to the central frame support 22 and the base 12. The back pressure roller mounting assemblies 54, 56 are fixedly secured to the central frame support 22 and the base 12 during operation. Back pressure rollers 58, 60 are rotatably mounted to the mounting assemblies 54, 56 and are provided with sleeves 38. As with the front pressure rollers, the position of the sleeves 38 is adjustable by sliding the sleeves 38 along the back pressure rollers 58, 60. The sleeves 38 are fixedly mounted during operation. Back pressure roller guards 62 are also mounted to the mounting assemblies 54, 56 for safety reasons.

In one embodiment, the sleeves 38 on the back pressure rollers are positioned at different heights than the sleeves 38 on the front pressure rollers to provide horizontal pressure at different levels along the length of the drum 27. Thus, for example, as shown in FIG. 3, the back pressure roller 60 has seven sleeves 38 while the front pressure roller 35 has six sleeves 38. The sleeves 38 are mutually aligned with the gaps between sleeves in the opposite pressure roller. The same condition is true for front pressure roller 34 and corresponding back pressure roller 58. Such alignment thus provides pressure at different levels from diagonally opposed rollers 34, 60 and 35, 58 and assists in obtaining the desired cross-cracking in the core of the powdered product.

Figure 2:
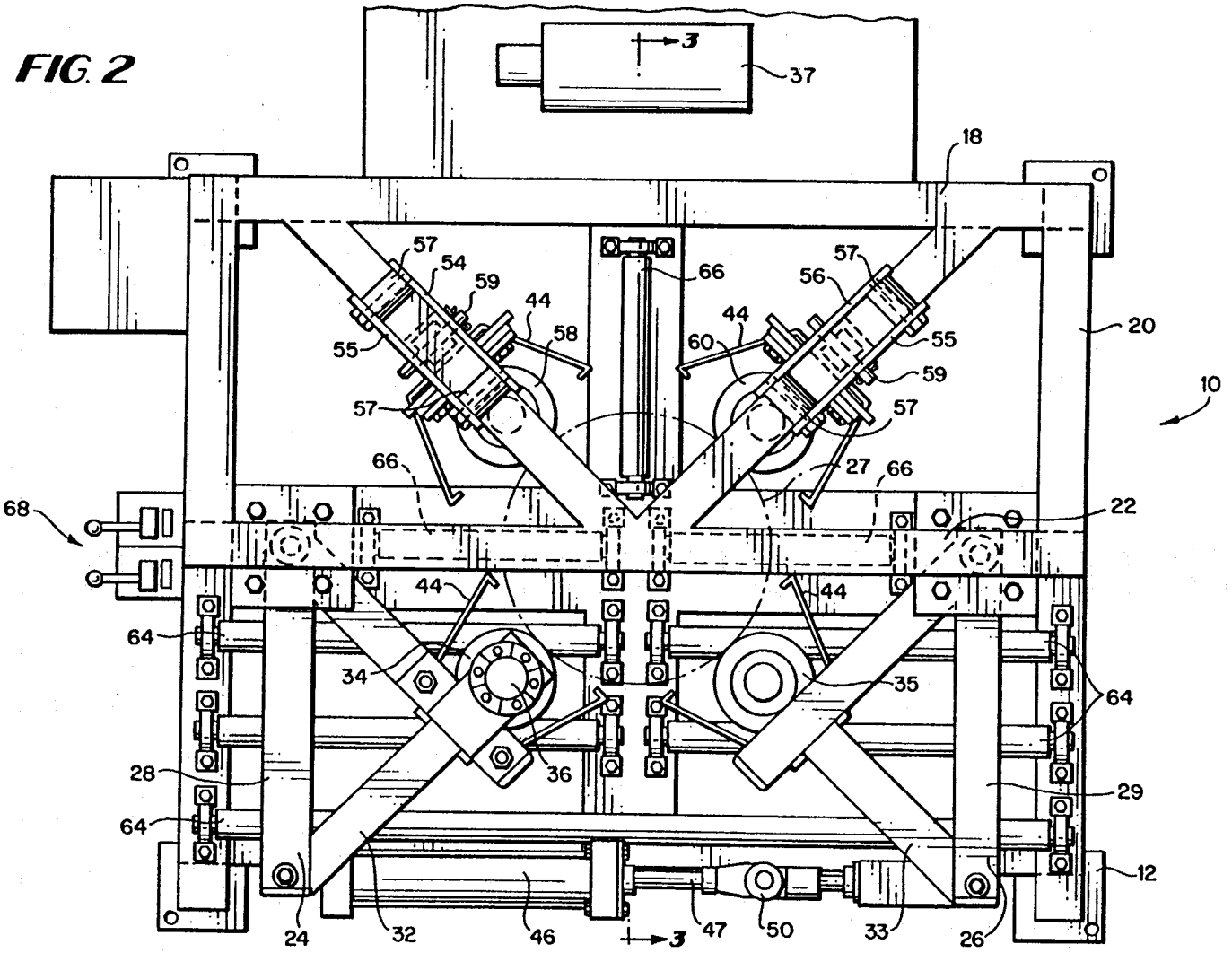
FIG. 2 is a top plan view of the drum conditioner of the present invention with a drum shown in phantom.
Figure 5A:
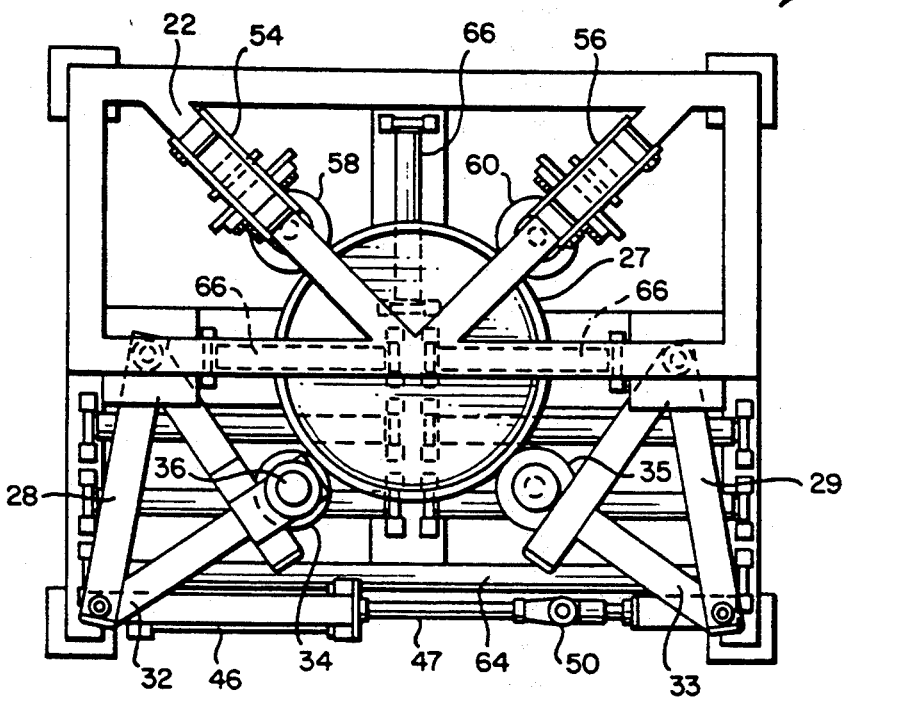
FIG. 5*a* is a top plan view of the drum conditioner with a large-sized drum.
Figure 5B:
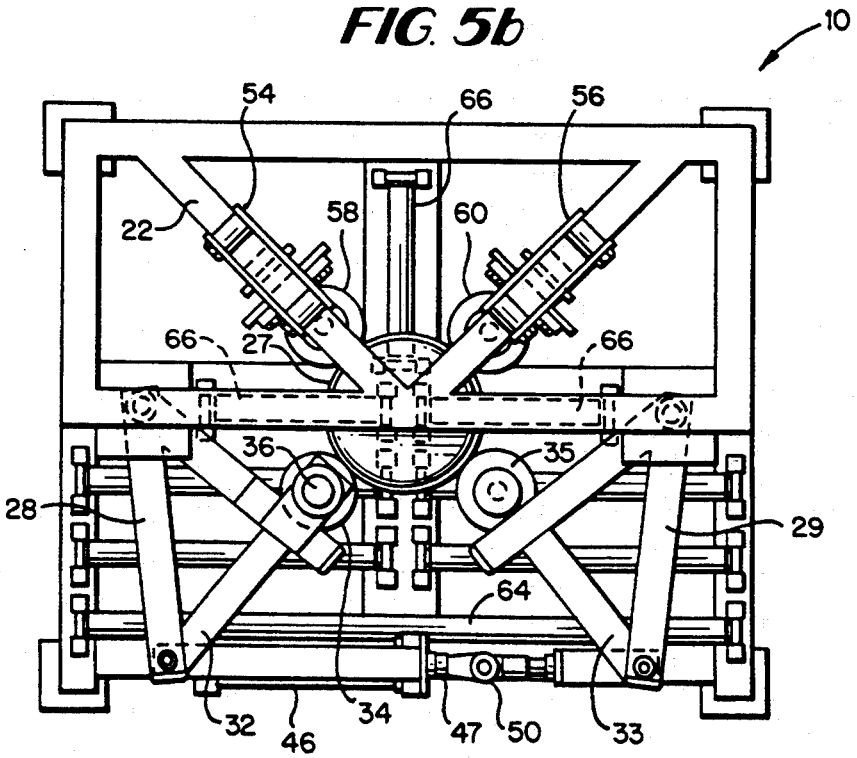
FIG. 5*b* is a top plan view of the drum conditioner with a small-sized drum.

As shown in FIG. 2, the back pressure roller mounting assemblies 54, 56 include guides 55, guide rollers 57 and quick-pins 59 or similar releasable securing means to permit relocating these assemblies 54, 56 radially inward or outward from the center of drum rotation so as to accommodate drums of different diameters. In FIGS. 5*a* and 5*b*, there are shown the respective positions of the various assemblies for use with a large sized drum and a small sized drum.

The base 12 of the drum conditioner 10 is provided with a bed of rollers 64 on which the object drum is moved in and out of the drum conditioner 10, as shown in FIGS. 1 through 3. Additionally, a raised set of three rollers 66 is provided on the base 12 at a height slightly higher than the remaining roller bed 64 so as to allow the object drum to rotate during operation without dragging it across the bed of rollers 64. The raised rollers 66 are set at 90 degrees apart and radially outward from the center of drum rotation. This construction provides a support surface for the drum during operation which is somewhat forgiving to the exact center of the drum relative to the support surface.

Figure 4A:
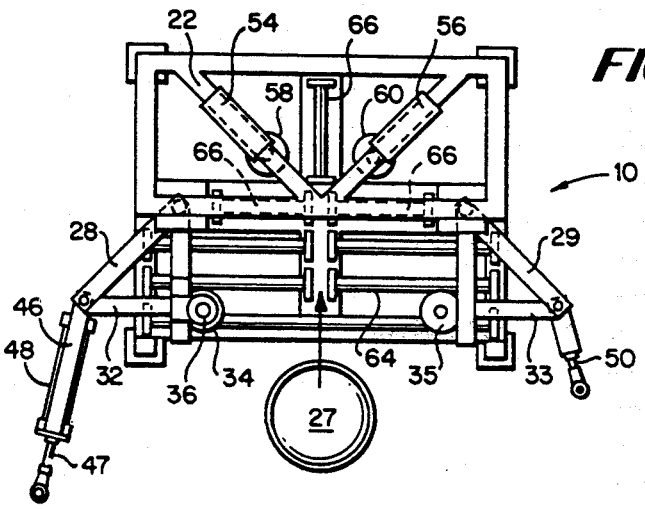
FIG. 4*a* is a top plan view of the drum conditioner shown in open position for the loading of a drum.

In operation, an object drum to be conditioned is placed on the bed of rollers 64, as shown in FIG. 4*a*, where it is then rolled to the center of the drum conditioner 10 to rest on the raised set of rollers 66. The back pressure roller mounting assemblies 54, 56 are set in place according to the diameter of the object drum such that the sleeves 38 on the back pressure rollers 58, 60 are in contact with the object drum.

Figure 4B:
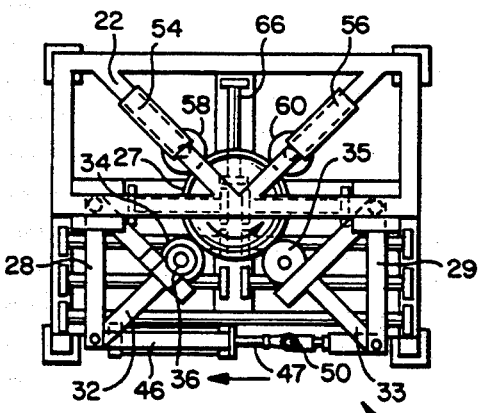
FIG. 4*b* is a top plan view of the drum conditioner, showing a drum being rotated and compressed.

The front gate assemblies 24, 26 are then shut and connected by the clevis pin attachment 50 to the piston rod 47. The hydraulic cylinder 46 is retracted slightly by operating control levers 68 to compress the compression spring 52 enough to permit the sleeves 38 to float on the surface of the object drum to accommodate out-of-round drums. Hydraulic power is then supplied by the hydraulic motor 36 connected directly to the left front pressure roller 34, as shown in FIG. 4*b*, so as to rotate the object drum on the raised set of rollers 66 through the action of the O-rings 42 mounted in the grooves 41 of the pressure roller sleeves 38 on the left front pressure roller 34. This loosens the perimeter of the product core within the object drum.

Figure 4C:
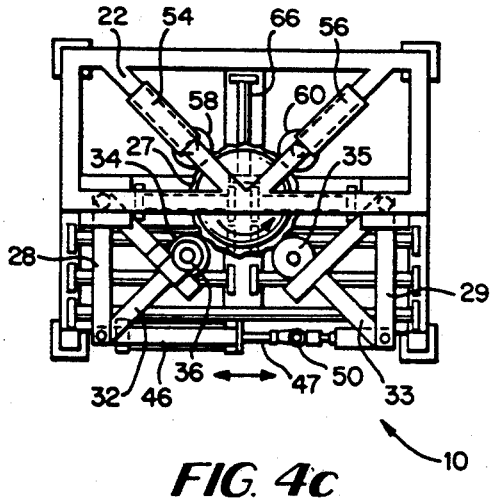
FIG. 4*c* is a top plan view of the drum conditioner showing a deformed drum being subjected to high pressure.

Next, the rotation phase is stopped, and the hydraulic cylinder 46 is retracted until the product core cracks. This is caused by the pressure created by the sleeves 38 on the front pressure rollers 34, 35. The hydraulic cylinder 46 is then extended to relieve pressure on the object drum. The object drum is then rotated manually on the raised set of rollers 66, as shown in FIG. 4*c*, and the hydraulic cylinder 46 is again retracted to crack the product core within the object drum.

This process is repeated with manual rotation at increments of about 30 degrees, for example, until the entire product core is loosened. The action of the four pressure rollers 34, 35, 58, 60 during operation creates vertical cracking of the product core within the object drum. This is combined with the horizontal cracking of the product core caused by the staggering of the sleeves 38 at alternating levels on diagonally opposite pressure rollers 34, 60 and 35, 58. The creation of both horizontal and vertical cracking of the product core within the object drum uniquely allows the entire product core to be loosened and easily removed from the object drum.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by letters patent is:

1. A drum conditioner for rotating and providing external forces on a drum or container to loosen powdered products or other material in a finely divided state contained therein, comprising:

a frame member having front and back portions;

a left gate assembly and a right gate assembly mounted on the front portion of said frame member, each of the gate assemblies having a pressure roller mounted vertically thereon for contact with said drum;

a pair of pressure rollers mounted vertically on the back portion of the frame member for contact with said drum;

means for rotating said drum; and means for applying external pressure on said drum; whereby the rotation of said drum and the application of external force to said drum act to loosen and crack the material contained within said drum.

2. The drum conditioner of claim 1 wherein said pressure applying means includes a hydraulic cylinder and piston rod mounted on one of said gate assemblies and a rod-end clevis attachment mounted on the other of said gate assemblies for engagement with the piston rod during operation.

3. The drum conditioner of claim 2 wherein the clevis attachment is provided with a compression spring to permit constant contact of the pressure roller with the drum during operation.

4. The drum conditioner of claim 1, wherein said rotating means includes means for rotating at least one of said pressure rollers.

5. The drum conditioner of claim 4 wherein said rotating means rotates at least one of the pressure rollers of the gate assemblies.

6. The drum conditioner of claim 5 wherein said at least one pressure roller of the gate assemblies has a plurality of sleeve members slidably mounted thereon.

7. The drum conditioner of claim 6 wherein said plurality of sleeve members are provided with knurled edges and an O-ring to assist in providing traction on the drum.

8. The drum conditioner of claim 1, further including a horizontal bed of rollers mounted on said frame member, said bed of rollers having a raised central portion to facilitate the movement of said drum.

9. The drum conditioner of claim 1 wherein at least one sleeve is mounted on each of said pressure rollers for contact with the drum.

10. The drum conditioner of claim 1 wherein said pressure rollers mounted on the back portion include means for adjusting the position thereof to accommodate drums of different sizes.

11. The drum conditioner of claim 1 wherein a plurality of sleeve members are slidably mounted at spaced intervals on at least one front pressure roller and at least one back pressure roller, and wherein the sleeves on one roller are aligned with the gaps between sleeves on the other roller, thus providing pressure at different levels around the circumference of the drum.

* * * * *